US011149742B2

(12) United States Patent
Honma et al.

(10) Patent No.: US 11,149,742 B2
(45) Date of Patent: Oct. 19, 2021

(54) AXIAL-FLOW FAN AND OUTDOOR UNIT

(71) Applicant: Mitsubishi Electric Corporation, Chiyoda-ku (JP)

(72) Inventors: Naohiko Honma, Chiyoda-ku (JP); Takahide Tadokoro, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 593 days.

(21) Appl. No.: 16/077,597

(22) PCT Filed: Sep. 27, 2016

(86) PCT No.: PCT/JP2016/078372
§ 371 (c)(1),
(2) Date: Aug. 13, 2018

(87) PCT Pub. No.: WO2017/154246
PCT Pub. Date: Sep. 14, 2017

(65) Prior Publication Data

US 2019/0048890 A1 Feb. 14, 2019

(30) Foreign Application Priority Data

Mar. 7, 2016 (JP) ..... JP2016-043055

(51) Int. Cl.
*F04D 29/38* (2006.01)
*F04D 29/66* (2006.01)
*F24F 1/38* (2011.01)

(52) U.S. Cl.
CPC ..... *F04D 29/384* (2013.01); *F04D 29/38* (2013.01); *F04D 29/663* (2013.01); *F24F 1/38* (2013.01)

(58) Field of Classification Search
CPC ..... F04D 29/38; F04D 29/384; F04D 29/663; F24F 1/38
See application file for complete search history.

(56) References Cited

U.S. PATENT DOCUMENTS 1,895,252 A * 1/1933 Kontos ..... B64C 11/16 416/242
4,737,077 A * 4/1988 Vera ..... F04D 29/384 416/242

(Continued)

FOREIGN PATENT DOCUMENTS

JP 2002-371994 A 12/2002
JP 2010-150945 A 7/2010
WO WO 2014/102970 A1 7/2014

OTHER PUBLICATIONS

International Search Report dated Dec. 20, 2016 in PCT/JP2016/078372 filed Sep. 27, 2016.

*Primary Examiner* — Kenneth Bomberg
*Assistant Examiner* — Adam W Brown
(74) *Attorney, Agent, or Firm* — Xsensus LLP

(57) ABSTRACT

An axial-flow fan includes an impeller including plural blades fixed to an outer peripheral portion of the hub and each surrounded by an inner peripheral edge, an outer peripheral edge, a leading edge, and a trailing edge. The leading edge is forward-curved in a rotational direction with an angle increasing to outer periphery of the impeller and runs toward an outer periphery up to point A, the trailing edge is forward-curved in the rotational direction and runs toward the outer periphery up to point D, recedes in the rotational direction of the impeller as the trailing edge runs toward the outer periphery up to point A' located closer to the outer periphery than point D is to the outer periphery, advances in the rotational direction of the impeller in a region between point A' and point B', and reflexed at point D and point A'.

8 Claims, 10 Drawing Sheets

(56) References Cited

U.S. PATENT DOCUMENTS

| | | | | |
|---|---|---|---|---|
| 6,065,937 | A * | 5/2000 | Hunt | F04D 29/326<br>416/169 A |
| 6,254,342 | B1 * | 7/2001 | Fujinaka | F04D 25/08<br>415/119 |
| 6,447,251 | B1 * | 9/2002 | Zeng | F04D 29/384<br>416/210 R |
| 6,712,584 | B2 * | 3/2004 | Zeng | F04D 29/384<br>416/210 R |
| 6,814,545 | B2 * | 11/2004 | Hext, III | F04D 29/384<br>416/210 R |
| 9,897,108 | B2 * | 2/2018 | Tadokoro | F04D 29/663 |
| 10,767,656 | B2 * | 9/2020 | Hamada | F04D 29/34 |
| 2003/0012656 | A1 | 1/2003 | Cho et al. | |
| 2010/0266428 | A1 * | 10/2010 | Nakagawa | F04D 29/164<br>417/321 |
| 2015/0345513 | A1 | 12/2015 | Tadokoro et al. | |

* cited by examiner

AXIAL-FLOW FAN AND OUTDOOR UNIT

TECHNICAL FIELD

The present invention relates to an axial-flow fan and outdoor unit used, for example, for an air-conditioning apparatus or ventilation equipment, and more particularly, to a blade shape in an impeller.

BACKGROUND ART

Conventionally, an axial-flow fan is used by being incorporated into an outdoor unit of a heat pump air-conditioning apparatus or the like, as well as a pressure ventilation fan. For example, the axial-flow fan includes an impeller, which in turn includes a cylindrical hub and a plurality of blades provided on an outer peripheral surface of the hub. The hub is rotated, for example, counterclockwise turning the blades and thereby sending out a fluid such as air rearward from the front.

The outdoor units of an air-conditioning apparatuses and the like, as well as the pressure ventilator fan and the like used by being incorporated into various devices have draft resistance, and the draft resistance changes depending on the installation environment, operating conditions, and other conditions. When sand, dust, or the like deposits on a heat exchanger, or because devices grow more densely mounted, the mounted axial-flow fan is required to provide a high static pressure. To increase static pressure, it is necessary to increase rotation speed of the impeller being driven. However, if the blades of the axial-flow fan are turned at high speed, vortexes are generated on end portions and the like of outer peripheral edges (blade tips), leading edges, and trailing edges of the blades, causing disadvantages.

For example, the vortexes generated by the blades reduce effective passage width among the blades and present resistance to flow, thereby generating turbulence in the flow. Consequently, the axial-flow fan experiences increase in aerodynamic loss and noise. Also, vortexes are generated mostly on suction surfaces (suction side) and pressure at centers of vortexes is very low. Consequently, a negative pressure area increases on the suction surface under the influence of the vortexes, increasing torque in a direction opposite a rotational direction of the impeller. Therefore, there is a problem in that with increases in load on the blades, torque required (electric power required) to rotate the impeller increases, resulting in reduced efficiency.

From the above-stated point of view, axial-flow fans as described below are proposed as axial-flow fans capable of improving efficiency and reducing fluid noise. For example, there is an axial-flow fan having three or more bulging portions, of which bulging portions bulging to a suction surface side and bulging portions bulging to a positive pressure surface side alternate. In the axial-flow fan a distance from a neutral line dividing each blade equally between the bulging portions on the suction surface side and the bulging portions on the positive pressure surface side increases toward a trailing edge portion from a leading edge portion (see, for example, Patent Literature 1). Also, there is an axial-flow fan, in which a trailing edge portion includes a trailing edge projection projecting rearward in a rotational direction of an impeller and a radius at an apex of the trailing edge projection is set to be larger than a mean radius of an outer peripheral edge (blade tip) radius and inner peripheral edge (boss) radius (see, for example, Patent Literature 2).

CITATION LIST

Patent Literature

Patent Literature 1: Japanese Unexamined Patent Application Publication No. 2010-150945

Patent Literature 2: International Publication No. WO2014/102970

SUMMARY OF INVENTION

Technical Problem

Patent Literature 1 and Patent Literature 2 described above have the following problems. For example, the axial-flow fans described in Patent Literature 1 and Patent Literature 2 do not take any measures against vortexes generated in the leading edge portions and outer peripheral portions of conventional axial-flow fans, and the shape of the conventional axial-flow fans do not prevent generation of vortexes. The vortexes generated on the leading edges act as a noise source and develop negative pressure in the leading edge portions, thereby increasing torque in the rotational direction of the impeller and reducing efficiency. Blade tip vortexes generated by a pressure difference between a suction surface side (suction side) and pressure surface side (outlet side) on the outer peripheral edges become laminated with advection toward a downstream side, gradually growing and increasing in size. This reduces effective passage width among the blades. Also, as the blade tip vortexes obstruct flow of the fluid, flow resistance increases. Consequently, turbulence is generated in the fluid, causing an increase in nose and a reduction in efficiency.

The present invention has been made to overcome the above problems and has an object to provide a low-noise, high-efficiency axial-flow fan and outdoor unit.

Solution to Problem

An embodiment of the present invention provides an axial-flow fan comprising an impeller that includes a hub and a plurality of blades, the hub being configured to rotate around a rotating shaft, the plurality of blades being fixed to an outer peripheral portion of the hub and each defined by an inner peripheral edge, an outer peripheral edge, a leading edge, and a trailing edge, the leading edge of each of the blades, when viewed in a direction of the rotating shaft, being forward-curved in a rotational direction with an angle increasing to an outer periphery of the impeller up to point A located between point C and point B, the point C being a point of fixation to the hub, the point B being an intersection with the outer peripheral edge, and extending along a radial direction from a center of rotation in a region between the point A and the point B, and the trailing edge of each of the blades, when viewed in the direction of the rotating shaft, being forward-curved in the rotational direction of the impeller with an angle increasing to the outer periphery up to point D located between point E and point B', the point E being a point of fixation to the hub, the point B' being an intersection with the outer peripheral edge, being backward-curved in the rotational direction of the impeller with an angle increasing to the outer periphery up to point A' located closer to the outer periphery than the point D is to the outer periphery in a region between the point D and the point B', and being forward-curved in the rotational direction of the impeller in a region between the point A' and the point B', each of the blades being reflexed at the point D and the point A' in the trailing edge, wherein a distance between the center of rotation and the point A on the leading edge and a distance between the center of rotation and the point A' on the trailing edge are in a certain relation to each other, the certain relation being defined as being within a predetermined range, and in a zone in which the point A and the point A' are connected along the rotational direction of the impeller, the closer to the point A' the more greatly the blade projects to a suction side, and in a zone along the rotational direction of the impeller including the point D on the trailing edge, the closer to the point D, the more greatly the blade projects to an outlet side such that a height difference in the direction of the rotating shaft is greater on a side of the trailing edge than on a side of the leading edge.

Advantageous Effects of Invention

The axial-flow fan according to the embodiment of the present invention can increase lift in the rotational direction and increase a driving force while ensuring increases in static pressure. This makes it possible to reduce power requirements and improve efficiency. Also, because a blockage area (area presenting resistance) created by blade tip vortexes acting as a noise source can be reduced, facilitating flow of air, it is possible to provide a larger effective passage width than is possible with conventional axial-flow fans. Thus, noise can be reduced.

BRIEF DESCRIPTION OF DRAWINGS

FIG. 8 is a diagram (Part 1) showing a relationship among a section of the blade 3 in a cylindrical section A-A' of a same radius, a flow field around the section of the blade 3, and vortexes generated on the leading edge 33 and the like.

FIG. 9 is a diagram (Part 2) showing a relationship among a section of the blade 3 in a cylindrical section A-A' of a same radius, a flow field around the section of the blade 3, and vortexes generated on the leading edge 33 and the like.

DESCRIPTION OF EMBODIMENTS

Figure 1:
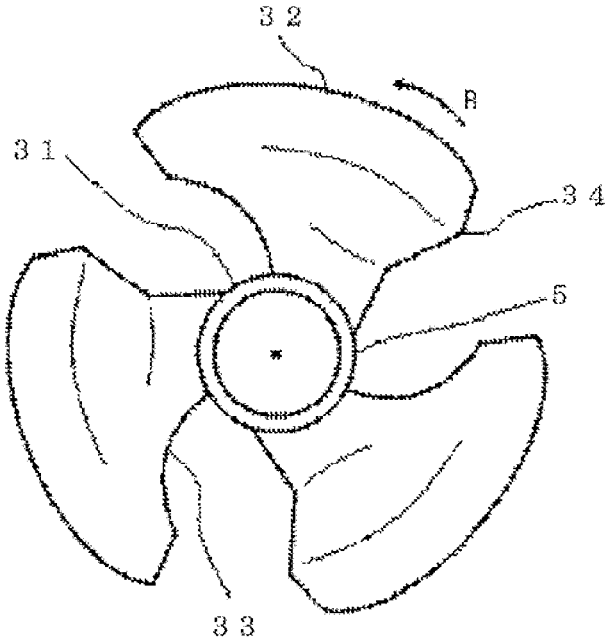
FIG. 1 is a diagram of an impeller 1 of an axial-flow fan according to Embodiment 1 of the present invention as viewed in front from a suction side.

Embodiments of the present invention will be described below with reference to the drawings. Regarding reference numerals/characters, in FIGS. 1 to 19, components denoted by the same reference numerals/characters are identical or equivalent components. This applies throughout the specification. Also, in the drawings, only a representative one of a plurality of blades is denoted by a reference numeral. Also, in the embodiments and drawings, a case in which the number of blades is three is illustrated as an example, but the present invention is effective and the advantages of the present invention can be achieved even when the number of blades is other than three.

Embodiment 1

FIG. 1 is a front view of an impeller 1 of an axial-flow fan according to Embodiment 1 of the present invention, the front view being a view from a suction side (viewed in a direction of a rotating shaft). As shown in FIG. 1, the impeller 1 of the axial-flow fan according to Embodiment 1 of the present invention includes a hub 5 configured to rotate around the rotating shaft (around an axis). Also, four blades 3 are disposed in an outer peripheral portion of the hub 5. Each of the blades 3 is surrounded by an inner peripheral edge 31, an outer peripheral edge (blade tip) 32, a leading edge 33, and a trailing edge 34.

Figure 2:
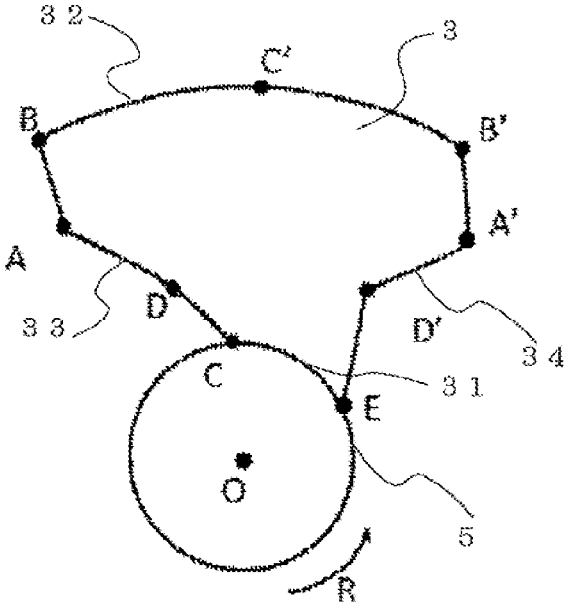
FIG. 2 is a diagram showing positions of reference points on a leading edge 33, outer peripheral edge 32, and trailing edge 34 that characterize a shape of a blade 3 in the axial-flow fan according to Embodiment 1 of the present invention.

FIG. 2 shows positions of reference points on the leading edge 33, the outer peripheral edge 32, and the trailing edge 34 that characterize a shape of the blade 3 in the axial-flow fan according to Embodiment 1 of the present invention. Here, point A is located on the leading edge 33 of the blade 3. Also, point B is located at an intersection between the outer peripheral edge 32 and leading edge 33 of the blade 3. Point C' is located in a central portion of the outer peripheral edge 32. Point B', point A', point D, and point E are located on the trailing edge 34 of the blade 3.

As shown in FIG. 2, when each blade 3 is viewed from a rotation center O, up to point A located between point C, which is located at an intersection of the inner peripheral edge 31 with the leading edge 33, and point B, which is located at an intersection of the outer peripheral edge 32 with the leading edge 33, the leading edge 33 is forward-curved in a rotational direction of the impeller and with an angle increasing to an outer periphery (to increase in angle toward the rotational direction). Also, in a region between point A and point B, the leading edge 33 is shaped to extend along a radial direction from the rotation center O. On the other hand, when each blade 3 is viewed from the rotation center O, up to point D located between point E, which is located at an intersection of the inner peripheral edge 31 with the trailing edge 34, and point B', which is located at an intersection of the outer peripheral edge 32 with the trailing edge 34, the trailing edge 34 is forward-curved in the rotational direction toward the outer periphery. Also, from point D up to point A' located closer to the outer periphery than point D is to the outer periphery, the trailing edge 34 is backward-curved in the rotational direction with an angle increasing to the outer periphery (to increase in angle toward a side opposite to the rotational direction). Also, the trailing edge 34 is forward-curved in the rotational direction in a region between point A' and point B', and reflexed at point D and point A.

Figure 3:
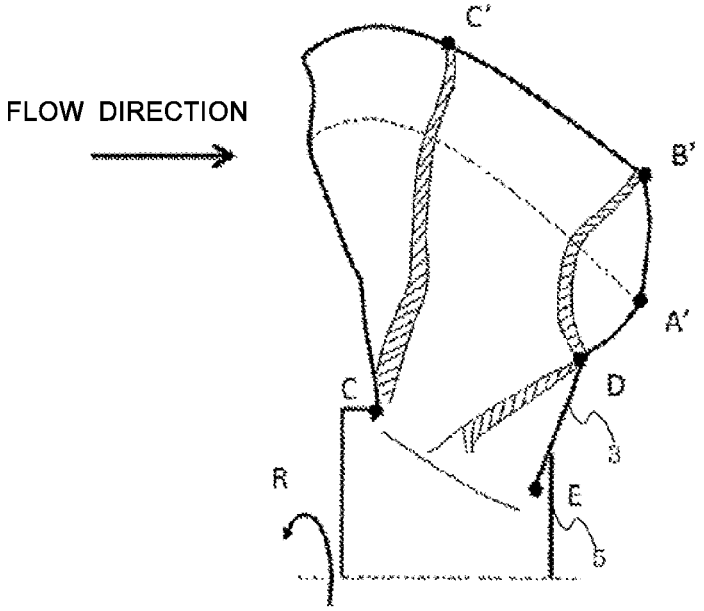
FIG. 3 is a diagram of the impeller 1 of the axial-flow fan according to Embodiment 1 of the present invention as viewed from a lateral side.

FIG. 3 is a diagram of the impeller 1 of the axial-flow fan according to Embodiment 1 of the present invention as viewed from a lateral side. FIG. 3 shows a single blade 3. FIG. 3 shows the shape of the blade 3 in section O-C' and section O-B' perpendicular to the rotating shaft.

Figure 4:
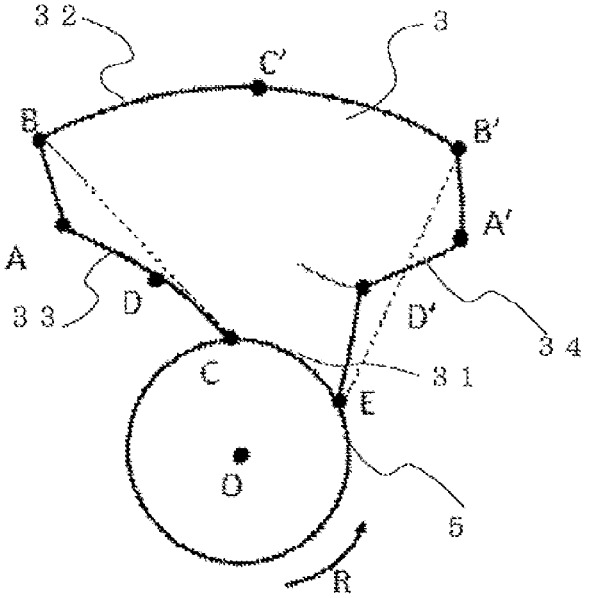
FIG. 4 is a diagram showing line segment B-C and line segment E-B' on the axial-flow fan according to Embodiment 1 of the present invention.

FIG. 4 is a diagram showing line segment B-C and line segment E-B' on the axial-flow fan according to Embodiment 1 of the present invention. Line segment B-C is a line that connects point B at the intersection of the outer peripheral edge 32 with the leading edge 33 and point C at the intersection of the inner peripheral edge 31 (boss 5) with the leading edge 33. Also, line segment E-B' is a line that connects point B' at the intersection of the outer peripheral edge 32 with the trailing edge 34 and point E at the intersection of the inner peripheral edge 31 with the trailing edge 34. FIG. 4 shows a single blade 3. In FIG. 4, point D and point A on the leading edge 33 is forward of line segment B-C in the rotational direction. Also, point D' and point A' on the trailing edge 34 is backward of the line segment E-B' in the rotational direction. The blades 3 shaped in this way can reduce torque acting in a direction opposite to the rotation of the blades 3, thereby reduce loads on the blades 3, and further improving efficiency.

Figure 5:
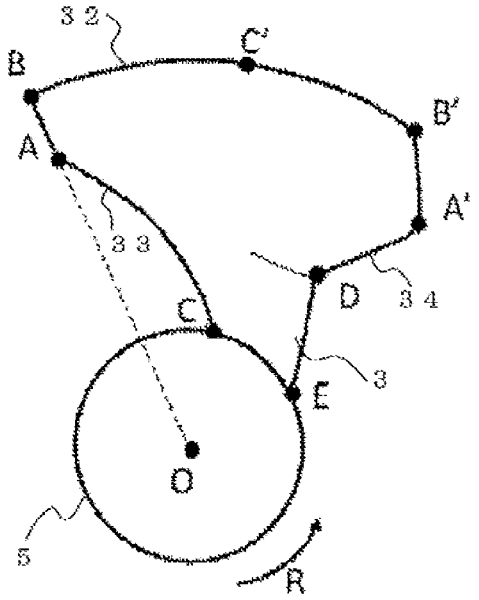
FIG. 5 is a diagram showing a relationship between line segment O-B and line segment A-B on the axial-flow fan according to Embodiment 1 of the present invention.

FIG. 5 is a diagram showing a relationship between line segment O-B and line segment A-B on the axial-flow fan according to Embodiment 1 of the present invention. Line segment O-B is a line that connects the rotation center O and point B at the intersection of the outer peripheral edge 32 with the leading edge. FIG. 5 shows that line segment O-B and line segment A-B connecting point A and point B on the leading edge 33 are parallel to each other. FIG. 5 shows a single blade 3.

Figure 6:
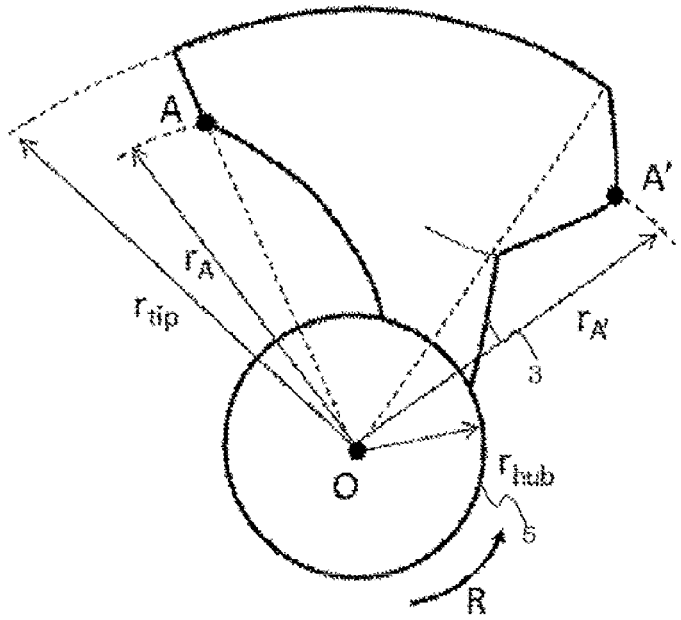
FIG. 6 is a diagram showing a relationship among distances from a rotation center O in the axial-flow fan according to Embodiment 1 of the present invention.

FIG. 6 is a diagram showing a relationship among distances from the rotation center O in the axial-flow fan according to Embodiment 1 of the present invention. In FIG. 6, a distance from the rotation center O to point A on the leading edge 33 is designated as radius $r_A$. Also, a distance from the rotation center O to point A' on the trailing edge 34 is designated as radius $r_{A'}$. Furthermore, a distance from the rotation center O to point B (blade tip) on the leading edge 33 is designated as tip radius $r_{tip}$. Besides, a distance from the rotation center O to an outer peripheral surface of the hub 5 is designated as hub radius $r_{hub}$. Here, the distance of radius $r_A$ and distance of radius $r_{A'}$ have such a relationship that the distances can be equated with each other. For example, radius $r_{A'}$ can be 0.9 to 1.1 times radius $r_A$.

Figure 7:
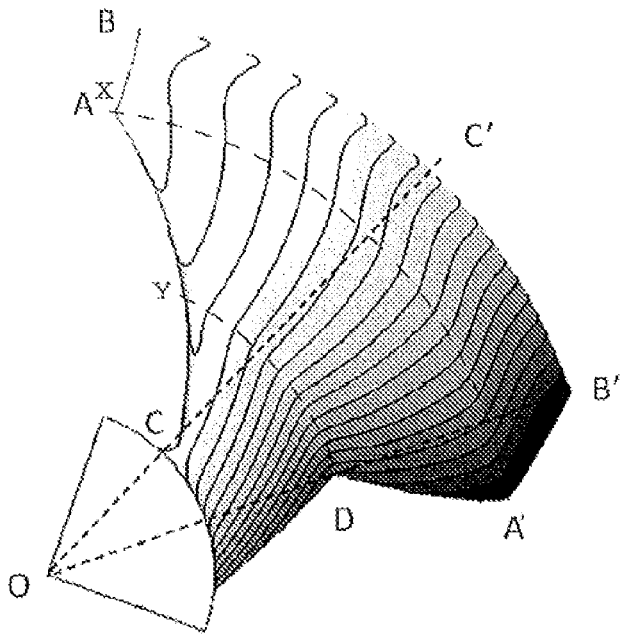
FIG. 7 is a diagram showing a height distribution in a direction of a rotating shaft on the blade 3 in the axial-flow fan according to Embodiment 1 of the present invention, where the height distribution is represented by contour lines.

FIG. 7 is a diagram showing a height distribution in the direction of the rotating shaft on the blade 3 in the axial-flow fan according to Embodiment 1 of the present invention, where the height distribution is represented by contour lines. Regarding contour colors of the contour lines, black color corresponds to an outlet side and white color corresponds to the suction side.

As shown in FIG. 7, the blade 3 is shaped to project to the suction side in a zone along the rotational direction in a region from point A on the leading edge 33 to point A' on the trailing edge 34 and project to the outlet side in a zone along the rotational direction including point D on the trailing edge 34. In a section of the blade 3 including the rotating shaft, apexes projecting to the suction side are maximum points. On the other hand, apexes projecting to the outlet side are minimum points. A curve connecting point A on the leading edge 33 and point A' on the trailing edge 34 along the shape of the blade 3, generally looks like line X. In a zone along line X, the closer to point A' on the trailing edge 34 away from point A on the leading edge 33, the more greatly the blade 3 projects to the suction side.

Also, a line on a circumference of a circle having a radius being a distance from the rotation center O to point D on the trailing edge 34 is designated as line Y. On line Y, the closer to point D on the trailing edge 34, the more greatly the blade 3 projects to the outlet side, and a height difference in the direction of the rotating shaft is greater on the trailing edge 34 than on the leading edge 33. This can also be seen from the fact that in FIG. 7, in relation to the height in the direction of the rotating shaft, whereas there are approximately four contour lines that intersect line O-C' connecting the rotation center O and point C', there are ten or more contour lines that intersect line O-B' connecting the rotation center O and point B'. Therefore, the height difference in the direction of the rotating shaft (height in the direction of the rotating shaft) between a position of the maximum point and a position of the minimum point is greater on the side of the trailing edge 34 than on the side of the leading edge 33. This induces a flow oriented outward in a radial direction of the impeller 1 allowing increases in static pressure not only due to reductions in relative speed, but also due to centrifugal action. Also, the loads on the blades 3 can be reduced. Thus, increases in static pressure and reductions in torque requirements make it possible to improve efficiency.

Also, regarding a position of point D on the trailing edge 34 in the radial direction, the distance from the rotation center O to point D is designated as radius O-D. Also, a distance from the rotation center O to point B' on the outer peripheral edge 32 is designated as radius O-B'. The blades 3 is configured such that radius O-D will be generally half of radius O-B'.

A distance of point D from the rotation center O is about intermediate between point A' and point E located on the outer peripheral surface of the hub 5. For example, a distance from the center of rotation O to point E is designated as radius OE. If radius $r_{A'}$ is larger than twice radius OE, radius O-D can be 0.9 to 1.1 times $(OE+r_{A'})/2$.

Figure 8:
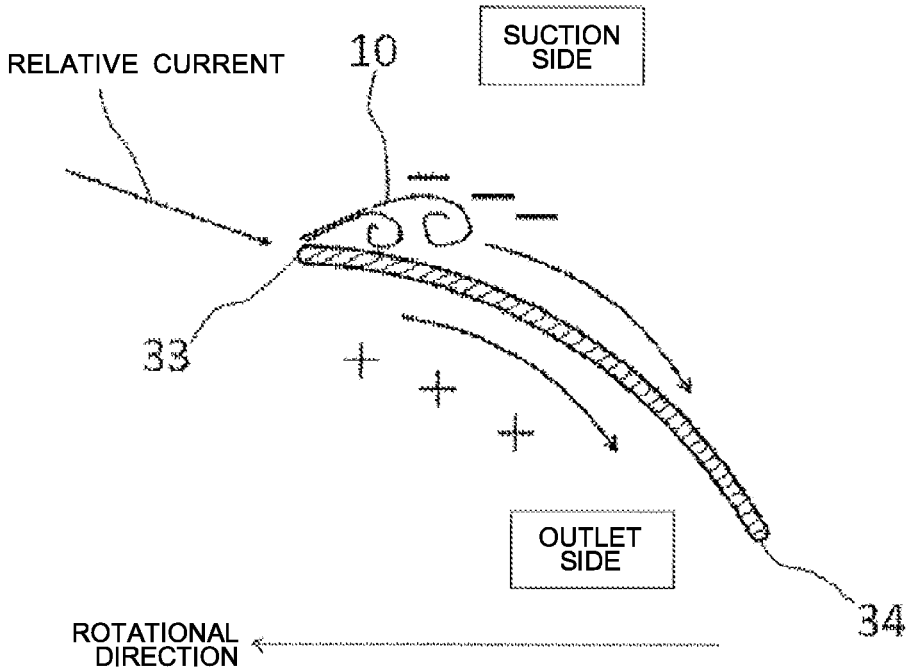
Figure 9:
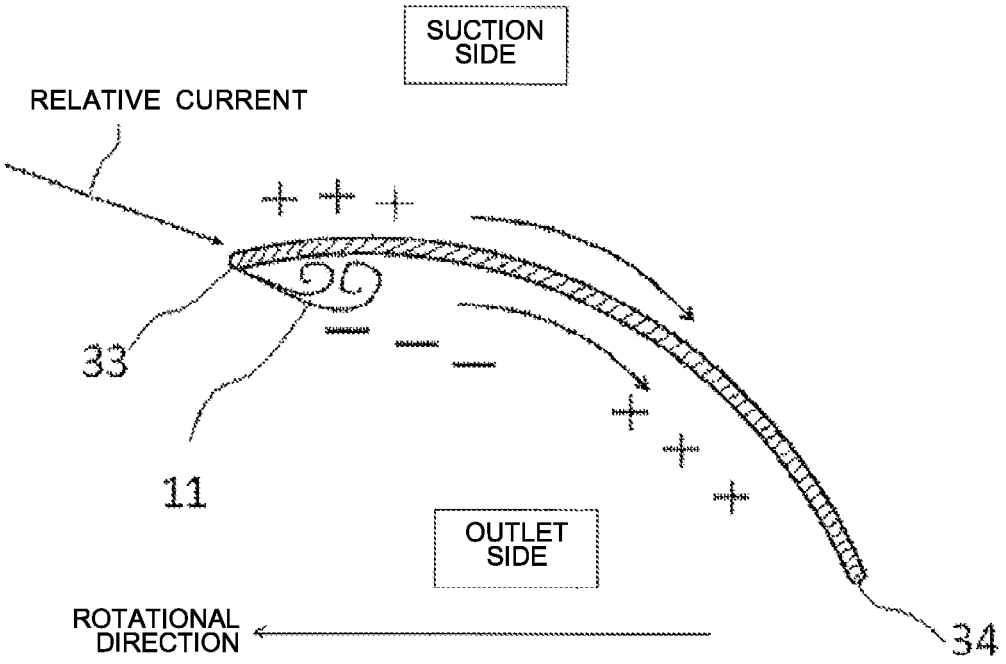

FIGS. 8 and 9 are diagrams showing relationships among a section of the blade 3 in a cylindrical section A-A' of a same radius, a flow field around the section of the blade 3, and vortexes generated on the leading edge 33 and the like. FIG. 8 shows a relationship among the section of the blade 3, flow field, and vortexes in the case of a conventional axial-flow fan. Also, FIG. 9 shows a relationship among the section of the blade 3, flow field, and vortexes in the case of a conventional axial-flow fan. Here, the + (plus) signs in FIGS. 8 and 9 mean a positive pressure higher than the atmospheric pressure. On the other hand, the – (minus) signs in FIGS. 8 and 9 mean a negative pressure lower than the atmospheric pressure.

For example, as shown in FIG. 8, with the conventional axial-flow fan, a relative current of air (fluid) flowing to a blade element is separated on the suction side (suction surface side) of the leading edge 33, generating vortexes 10. However, with the axial-flow fan of the present embodiment, in which the blade 3 is shaped as described above, a relative current of air flowing to a blade element generates a separation area 11 of vortexes on the outlet side (pressure surface side) of the leading edge 33. Consequently, with the conventional axial-flow fan, a neighborhood of the suction side of the leading edge 33 becomes a negative pressure area as indicated by minus signs in FIG. 8. On the other hand, with the axial-flow fan of the present embodiment, a positive pressure is created in a neighborhood of the suction side of the leading edge 33 as indicated by plus signs in FIG. 9.

Therefore, whereas with the conventional axial-flow fan, the negative pressure area on the suction side (suction surface side) generates increased lift, with the axial-flow fan according to Embodiment 1, the reduction in negative pressure area makes it possible to decrease lift and thereby reduce torque in the direction opposite to the rotational direction. Furthermore, because a vortex region is generated actively in a neighborhood of the outlet side (pressure surface side) of the leading edge 33, it is possible to increase lift in the rotational direction and increase a driving force. This provides an axial-flow fan capable of reducing electric power and improving efficiency.

Figure 10:
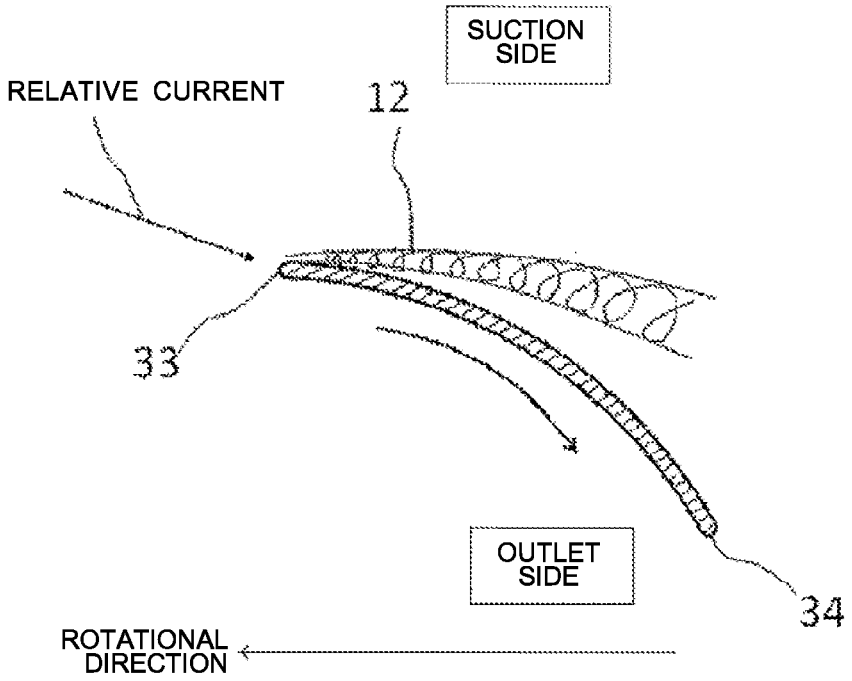
FIG. 10 is a diagram (Part 1) showing a blade tip vortex 12 generated in a blade tip portion on a suction surface of a blade.
Figure 11:
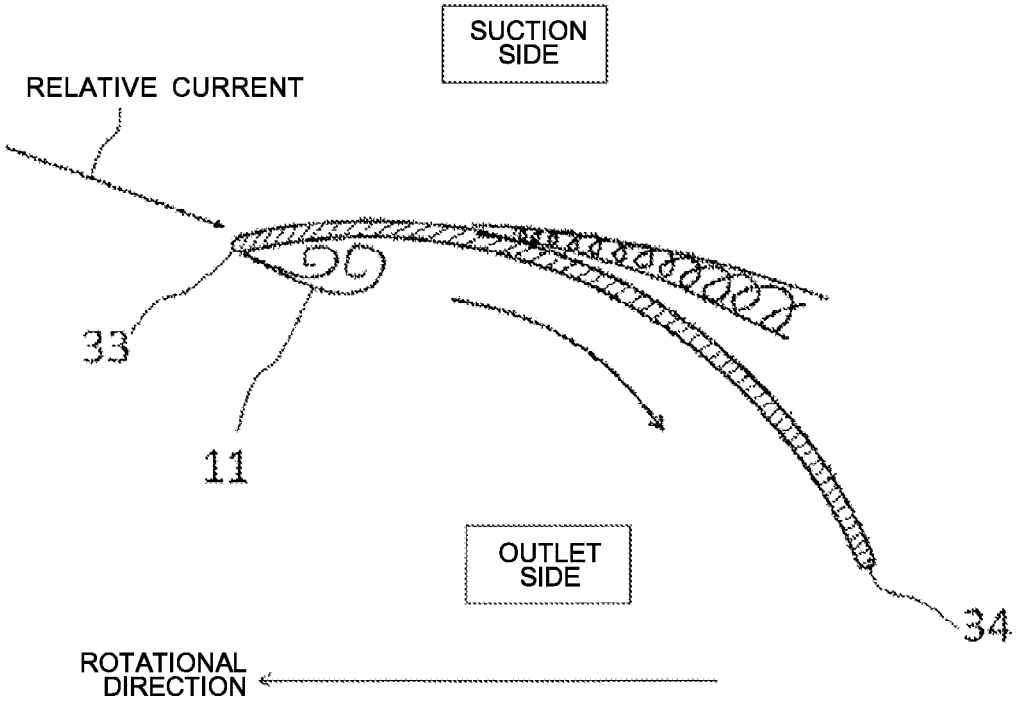
FIG. 11 is a diagram (Part 2) showing a blade tip vortex 12 generated in a blade tip portion on a suction surface of a blade.

FIGS. 10 and 11 are diagrams showing a blade tip vortex 12 generated in a blade tip portion on a suction surface of a blade. FIG. 10 shows a conventional axial-flow fan. FIG. 11 shows the axial-flow fan of the present embodiment. As shown in FIG. 10, with the conventional axial-flow fan, a blade tip vortex 12 is generated from nearby the leading edge 33 by a pressure difference between the suction surface and pressure surface. On the other hand, as shown in FIG. 11, with the axial-flow fan according to Embodiment 1, in a neighborhood of the leading edge 33, the pressure surface is under negative pressure and the suction surface is under positive pressure. Consequently, whereas a blade tip vortex 12 flows around to the suction surface from the pressure surface when generated by the conventional axial-flow fan, generation of such a blade tip vortex 12 can be retarded and caused to start from a place as close to the trailing edge 34 as possible. With the axial-flow fan according to Embodiment 1, a blockage area (area presenting resistance) created by the blade tip vortex 12 is narrowed by this action, causing air to flow smoothly, thereby making it possible to provide a larger effective passage width than is possible with the conventional axial-flow fan. Thus, noise can be reduced.

In so doing, in the neighborhood of the outlet side (pressure surface side) of the leading edge 33, part of flow is actively separated, and thus the flow no longer proceeds along the blade 3. Consequently, work cannot be done effectively on the flow, and it is likely that sufficient increases in static pressure cannot be ensured.

The axial-flow fan according to Embodiment 1 overcomes this problem as follows. For example, as shown in FIG. 2, when the blade 3 is viewed from the direction of the rotating shaft, between point E and point D in an interval from point E to point B' on the trailing edge 34, the trailing edge 34 is forward-curved in the rotational direction with an angle increasing toward an outer periphery of the blade 3. Also, up to point A' located closer to the outer periphery than point D is to the outer periphery, the trailing edge 34 is backward-curved in the rotational direction toward the outer periphery. This makes it possible to increase a length of a blade chord, and thereby ensure required increases in static pressure.

Also, for example, as shown in FIG. 7 described above, the blade 3 is shaped to project to the suction side in a zone along the rotational direction in the range from point A on the leading edge 33 to point A' on the trailing edge 34, and project to the outlet side in a zone along the rotational direction including point D on the trailing edge 34. In a zone along line X, the closer to point A' on the trailing edge 34 away from point A on the leading edge 33, the more greatly the blade 3 projects to the suction side. Also, on line Y on a circumference of the circle including point D on the trailing edge 34, the closer to point D on the trailing edge 34, the more greatly the blade 3 projects to the outlet side, and the blade 3 is S-shaped such that the height difference in the direction of the rotating shaft will be greater on the trailing edge 34 than on the leading edge 33.

Figure 12:
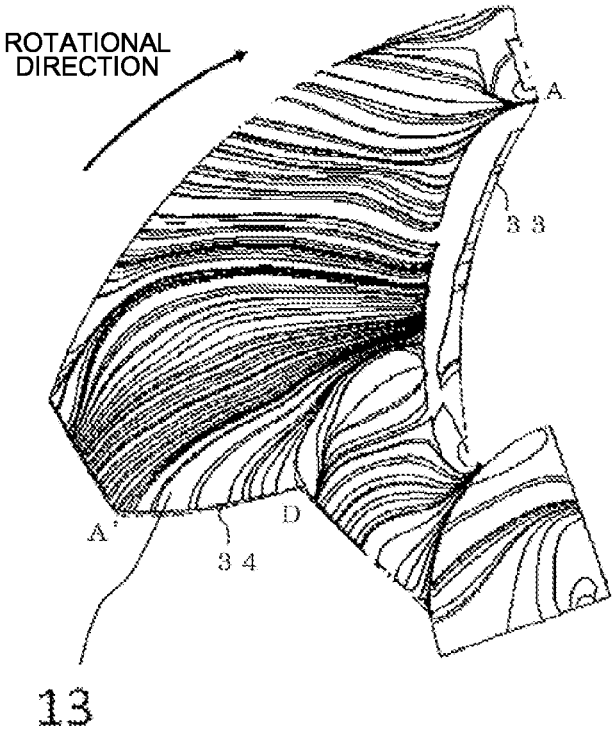
FIG. 12 is a schematic diagram showing a state (streamline) of a relative current of air flowing near a surface of the blade 3 in the axial-flow fan according to Embodiment 1 of the present invention when the blade 3 is viewed from an outlet side.

FIG. 12 is a schematic diagram showing a state (streamline) of a relative current of air flowing near a surface of the blade 3 in the axial-flow fan according to Embodiment 1 of the present invention when the blade 3 is viewed from the outlet side. As shown in FIG. 12, the air flowing in from the leading edge 33 flows to near point A' on the trailing edge 34. In so doing, since a current 13 oriented outward in the radial direction is induced on the pressure surface in such a way as to flow in from an inner peripheral side and flow out to the outer periphery, allowing increases in static pressure not only due to reductions in relative speed, but also due to centrifugal action, sufficient increases in static pressure can be ensured. At the same time, since the blade 3 is shaped such that the closer to point A' on the trailing edge 34 away from point A on the leading edge 33, the more greatly the blade 3 projects to the suction side, that the closer to point D on the trailing edge 34 on the circumference including point D on the trailing edge 34, the more greatly the blade 3 projects to the outlet side, and that the height difference in the direction of the rotating shaft is greater on the trailing edge than on the leading edge, it is possible to reduce a flow velocity component in a circumferential direction in a portion corresponding to the trailing edge 34 and reduce swirling dynamic pressure that is not converted into static pressure energy. This makes it possible to boost increases in static pressure and improve efficiency and reduce noise.

Next, an axial-flow fan configuration intended to further improve efficiency and reduce noise will be described. Here, based on hub radius $r_{hub}$ and tip radius $r_{tip}$, a middle radius $r_m$ given by Equation (1) below will be defined. The middle radius $r_m$ represents a distance of a midpoint on the blade 3 from the rotation center O in the radial direction.

$$r_m = r_{hub} + (r_{tip} - r_{hub})/2 \quad (1)$$

Then, for example, on the blade 3, radius $r_A$ and radius $r_{A'}$ described above are set to be larger than the middle radius $r_m$. Therefore, radius $r_A$>middle radius $r_m$, and radius $r_A$>middle radius $r_m$ are satisfied. Furthermore, regarding relationships between radii $r_A$ and $r_{A'}$ and tip radius $r_{tip}$, $0.84<r_A/r_{tip}<0.90$, and $0.84<r_A/r_{tip}<0.90$ are set to be satisfied. In the axial-flow fan of the present embodiment, the blades 3 are shaped such that the positions of point A and point A' will satisfy the above conditions.

Figure 13:
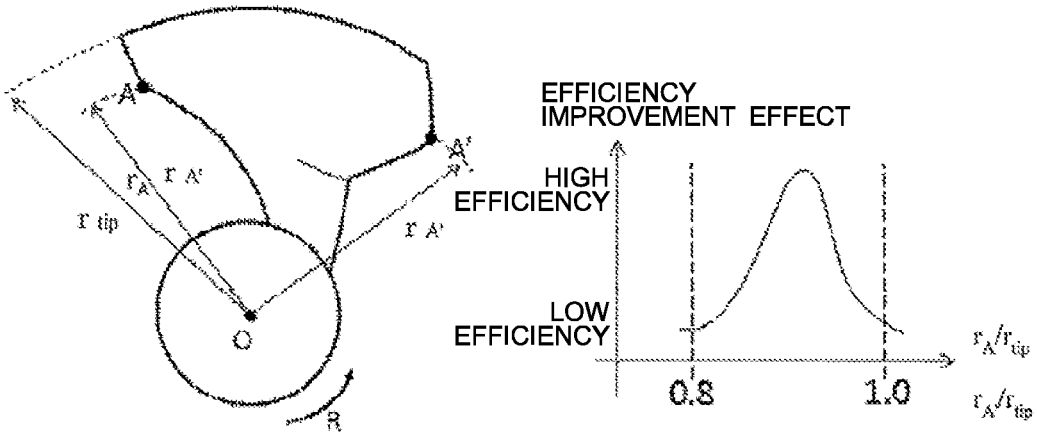
FIG. 13 is a diagram showing a relationship between $r_A/r_{tip}$ and efficiency in the axial-flow fan according to Embodiment 1 of the present invention.

FIG. 13 is a diagram showing a relationship between $r_A/r_{tip}$ and efficiency in the axial-flow fan according to Embodiment 1 of the present invention. Here, description will be given of a reason why efficiency is improved when $0.84<r_A/r_{tip}<0.90$, and $0.84<r_A/r_{tip}<0.90$ are satisfied. Here, an efficiency improvement effect is maximized when radius $r_A$ and radius $r_{A'}$ are equal ($r_A=r_{A'}$).

Torque acting on the axial-flow fan can be evaluated with the product of a radius, which is a moment arm, and a surface integral of pressure differences at individual parts of the blade 3. Therefore, to reduce the torque, it is effective to reduce the pressure difference between the pressure surface and suction surface on the blade tip side where the moment arm increases.

Thus, by shaping the blade 3 such that the positions of point A and point A' will satisfy not only radius $r_A$>middle radius $r_m$, and radius $r_A$>middle radius $r_m$, but also $0.84<r_A/r_{tip}<0.90$, and $0.84<r_A/r_{tip}<0.90$, it is possible to generate a vortex region on the pressure surface side in a portion corresponding to the leading edge 33 and not to generate a vortex on the suction surface side. Consequently, by sufficiently reducing torque in the direction opposite to the rotational direction and effectively generating a vortex region on the pressure surface side, causing lift to work in the vortex region, it is possible to increase a driving force in the rotational direction.

Also, since the efficiency can be further improved, rotation speed of the impeller 1 can be reduced. This enables noise reduction. Also, by positioning point A (point A') appropriately and by shaping each blade to extend along the radial direction from the center of rotation in the region between point A and point B, it is possible to sufficiently retard generation of blade tip vortexes such as generated at blade tips by conventional axial-flow fans. Consequently, the negative pressure area on the suction surface becomes smaller than in the case of the conventional axial-flow fans, reducing the blockage area created by the blade tip vortexes. This makes it possible to provide a large effective passage width that allows air to flow more smoothly than is possible with the conventional axial-flow fans. Thus, noise can be reduced further.

Embodiment 2

In Embodiment 1 described above, the efficiency is improved and noise is reduced by devising the shape of the blades 3 of the impeller 1. In Embodiment 2, description will be given of a shape of blades 3 which can further improve efficiency and reduce noise. An impeller 1 of an axial-flow fan according to Embodiment 2 has a configuration similar to that of Embodiment 1 described above except for portions described below.

Figure 14:
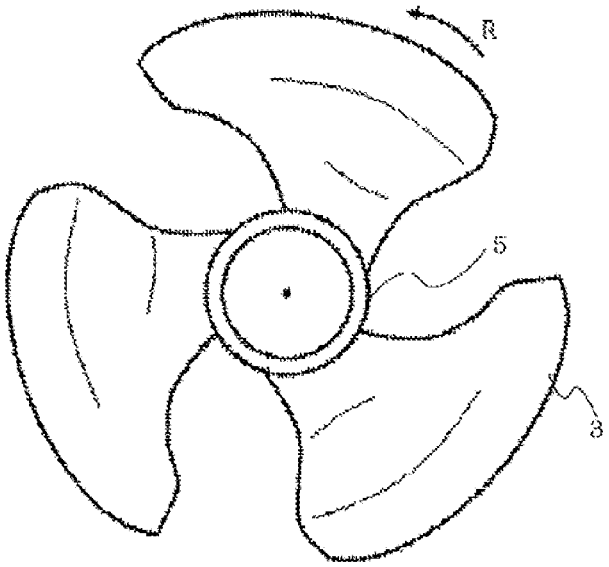
FIG. 14 is a diagram of an impeller 1 of an axial-flow fan according to Embodiment 2 of the present invention as viewed in front from the suction side.
Figure 15:
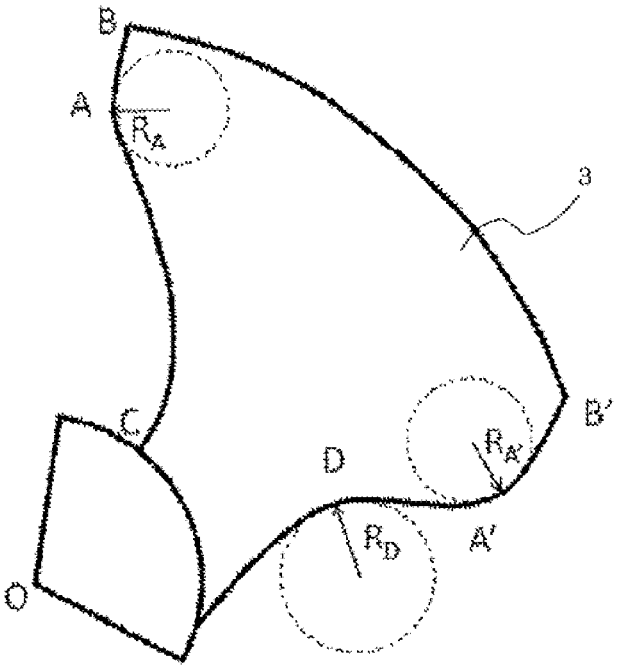
FIG. 15 is a diagram showing positions of reference points on a leading edge 33, outer peripheral edge 32, and trailing edge 34 that characterize a shape of a blade 3 in the axial-flow fan according to Embodiment 2 of the present invention as well as showing radii of curvature of the shape of the blade 3 at the positions.

FIG. 14 is a diagram of the impeller 1 of the axial-flow fan according to Embodiment 2 of the present invention as viewed in front from the suction side. Also, FIG. 15 is a diagram showing positions of reference points on a leading edge 33, outer peripheral edge 32, and trailing edge 34 that characterize a shape of the blade 3 in the axial-flow fan according to Embodiment 2 of the present invention as well as showing radii of curvature of the shape of the blade 3 at the positions.

Point A exists on the leading edge 33 located between point C, which is located at the intersection of the inner peripheral edge 31 with the leading edge 33, and point B, which is located at the intersection of the outer peripheral edge 32 with the leading edge 33. Also, point D exists on the trailing edge 34 located between point E, which is located at the intersection of the inner peripheral edge 31 with the trailing edge 34, and point B', which is located at the intersection of the outer peripheral edge 32 with the trailing edge 34. Also, on the trailing edge 34, point A' is located closer to the outer periphery than point D is to the outer periphery. When viewed in the direction of the rotating shaft, the blade 3 according to Embodiment 2 is rounded into a curved shape at point A, point D, and point A' rather than being angular. Here, as shown in FIG. 15, the radii of curvature at point A, point D, and point A' are $R_A$, $R_D$, and $R_{A'}$, respectively.

For example, on the leading edge 33 and trailing edge 34, the direction and speed of an air current change suddenly. When an air current changes suddenly, the flow is disturbed and presents air resistance, reducing efficiency. Also, it is known that vortexes are generated by a flow disturbance, causing noise. When the blades 3 are shaped as shown in FIGS. 14 and 15 as with Embodiment 2, sudden changes in air current speed on the leading edge 33 and trailing edge 34 can be inhibited. This makes it possible to further improve efficiency and reduce noise.

Here, to enhance the efficiency improvement effect and noise reduction effect, it is advised that the radius of curvature $r_A$ at point A is about ½ a distance AB from point A to point B. Also, it is advised that the radius of curvature $R_{A'}$ at point A' is equal to or less than ½ a distance A'B' from point A' to point B'. Furthermore, it is advised that the radius of curvature $R_D$ at point D is about ⅔ a distance DA' from point D to point A'.

Embodiment 3

Details of efficiency improvement and noise reduction of the axial-flow fans have been described above in Embodiment 1 and Embodiment 2. Use of the axial-flow fans described in Embodiment 1 and Embodiment 2 makes it possible to implement high-efficiency operation. If either of the axial-flow fans is mounted on an outdoor unit of an air-conditioning apparatus, water heater, or the like equipped with a compressor, heat exchanger, and the like, a volume of air passing through the heat exchanger can be increased while ensuring low noise and high efficiency. Thus, in Embodiment 3, an outdoor unit of an air-conditioning apparatus equipped with the axial-flow fan according to Embodiment 1 above will be described.

Figure 16:
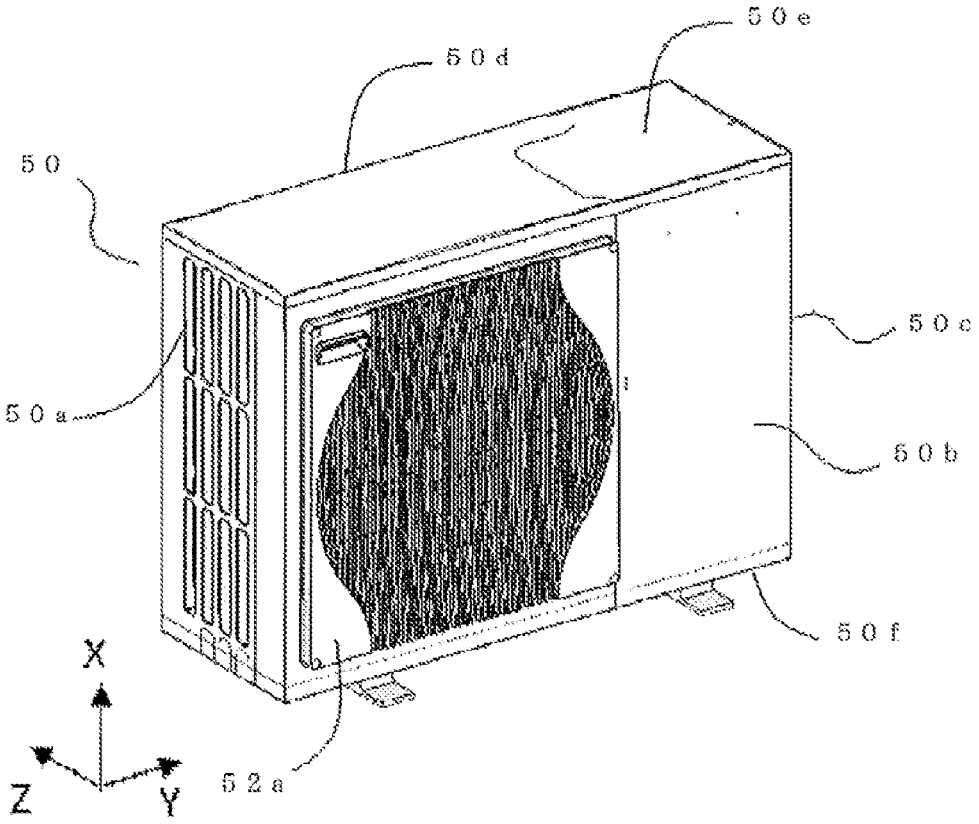
FIG. 16 is a perspective view of an outdoor unit according to Embodiment 3 of the present invention as viewed from an outlet side.
Figure 17:
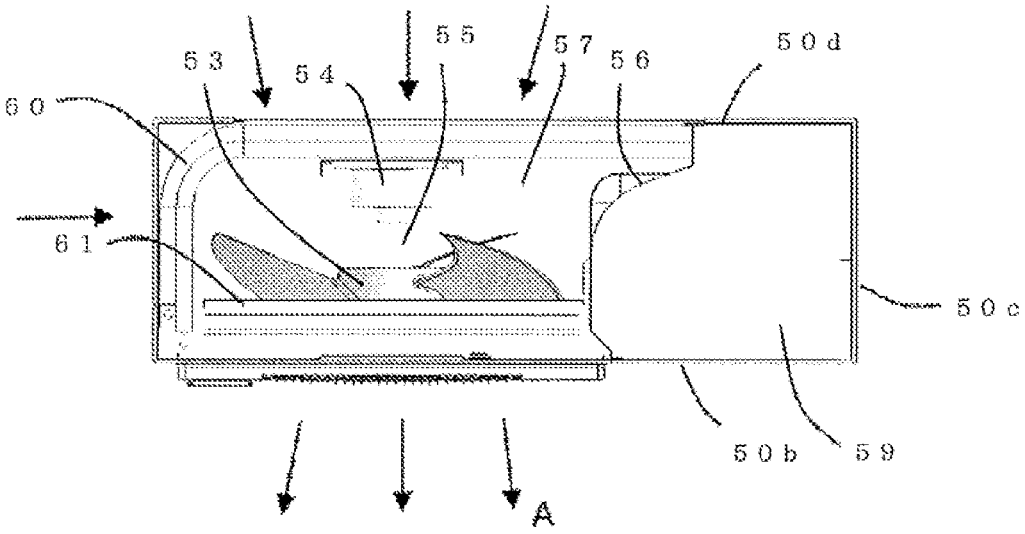
FIG. 17 is a diagram illustrating a configuration of the outdoor unit according to Embodiment 3 of the present invention as viewed from the side of a top face.
Figure 18:
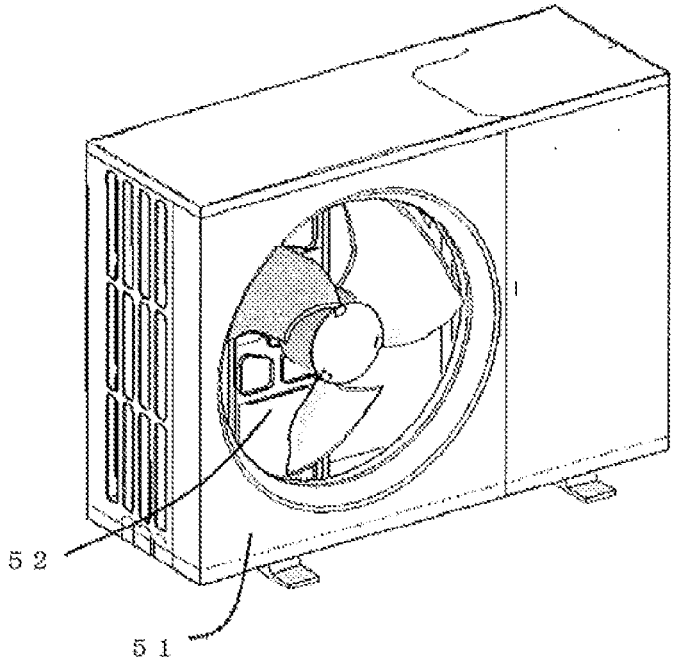
FIG. 18 is a schematic diagram of the outdoor unit according to Embodiment 3 of the present invention with a fan grille 52*a* removed.
Figure 19:
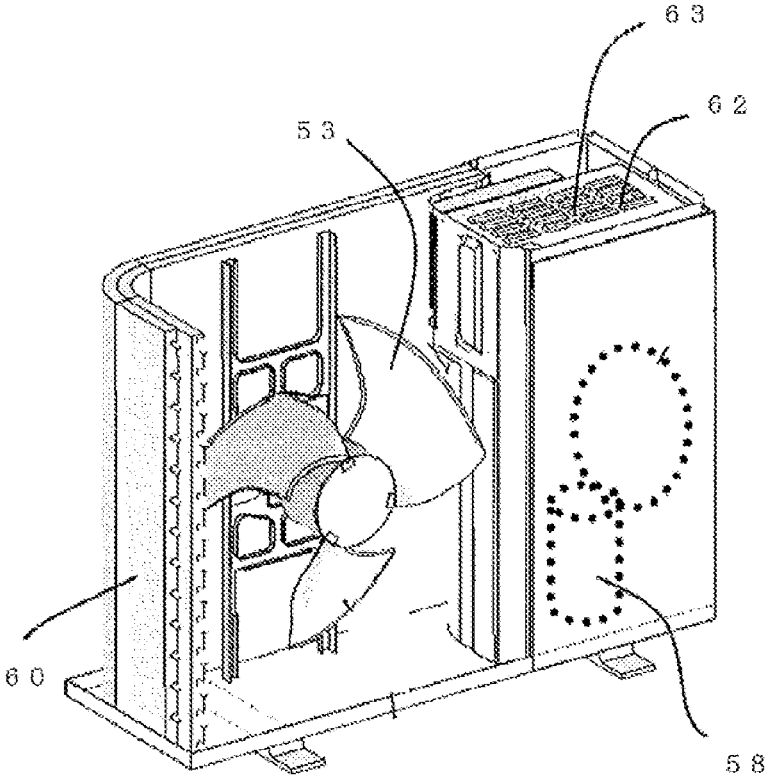
FIG. 19 is a diagram showing an internal configuration of the outdoor unit according to Embodiment 3 of the present invention.

FIG. 16 is a perspective view of the outdoor unit according to Embodiment 3 of the present invention as viewed from the outlet side. Also, FIG. 17 is a diagram illustrating a configuration of the outdoor unit according to Embodiment 3 of the present invention as viewed from the side of a top face. Furthermore, FIG. 18 is a schematic diagram of the outdoor unit according to Embodiment 3 of the present invention with a fan grille 52*a* removed. Besides, FIG. 19 is a diagram showing an internal configuration of the outdoor unit according to Embodiment 3 of the present invention.

As shown in FIGS. 16 to 19, an outdoor unit housing 50 is configured as a casing having a pair of right and left side faces 50*a* and 50*c*, a front face 50*b*, a back face 50*d*, a top face 50*e*, and a bottom face 50*f*. The side face 50*a* and back face 50*d* include opening ports used to suck air from the outside. Also, on the front face 50*b*, an air outlet 52 is formed in a front panel 51 as an opening portion used to blow out air. Furthermore, the air outlet 52 is covered with a fan grille 52*a*. The fan grille 52*a* is intended to prevent objects or the like from coming into contact with the axial-flow fan and thereby ensure safety. The axial-flow fan 53 is installed in the outdoor unit housing 50. The axial-flow fan 53 is connected with a fan motor 54 on the side of the back face 50*d* via a rotating shaft 55 and is rotationally driven by the fan motor 54. Inner part of the outdoor unit housing 50 is divided by a partition plate 56 into a fan chamber 57 in which the axial-flow fan 53 is housed and installed and a machine chamber 59 in which a compressor 58 is installed. In the fan chamber 57, a heat exchanger 60 is provided on the sides of the side face 50*a* and back face 50*d*, extending in an L shaped pattern.

A bell-mouth 61 is placed on an outer side, in the radial direction, of the axial-flow fan 53 installed in the fan chamber 57. The bell-mouth 61 is located outward of the peripheral edge of the blades and formed into an annular shape along the rotational direction of the axial-flow fan 53. Also, the partition plate 56 is located on a side face on one side of the bell-mouth 61 and part of the heat exchanger 60 is located on a side face on another side. A front end of the bell-mouth 61 is connected to the front panel 51 of the outdoor unit, surrounding an outer periphery of the air outlet 52. Passages on a suction side and outlet side of the bell-mouth 61 are configured by the bell-mouth 61 into an air course near the air outlet 52. The heat exchanger 60 provided on a suction side of the axial-flow fan 53 includes a plurality of fins arranged side by side in such a way that plate-like surfaces thereof will be parallel to one another, and a heat transfer tube penetrating the fins in the arrangement direction. Refrigerant circulating through a refrigerant circuit flows through the heat transfer tube. Also, the heat exchanger 60 is connected with a compressor 58 through a pipe. Also, a substrate box 62 is placed in the machine chamber 59 and equipment mounted in the outdoor unit is controlled by a control board 63 provided in the substrate box 62. In this way, Embodiment 3 provides an efficient outdoor unit by reducing noise in the device as a whole.

REFERENCE SIGNS LIST

1 impeller 3 blade 5 hub 10 vortex 11 separation area 12 blade tip vortex 31 inner peripheral edge 32 outer peripheral edge 33 leading edge 34 trailing edge 50 outdoor unit housing 50*a* side face 50*b* front face 50*d* back face 50*e* top face 50*f* bottom face 51 front panel 52 air outlet 52*a* fan grille 53 axial-flow fan 54 fan motor 55 rotating shaft 56 partition plate 57 fan chamber 58 compressor 59 machine chamber 60 heat exchanger 61 bell-mouth 62 substrate box 63 control board

The invention claimed is:

1. An axial-flow fan comprising an impeller that includes a hub and a plurality of blades, the hub being configured to rotate around an axis of a shaft, the plurality of blades being fixed to an outer peripheral portion of the hub and each defined by an inner peripheral edge, an outer peripheral edge, a leading edge, and a trailing edge, the leading edge of each of the blades, when viewed in a direction parallel to the axis of the shaft, being forward-curved in a rotational direction with an angle between a line from point O which is a center of the shaft to point C, and a line from the point O to the leading edge increasing towards an outer periphery of the impeller up to point A located between point C and point B, the point C being a point of fixation to the hub, the point B being an intersection with the outer peripheral edge, and extending along a radial direction from a center of rotation in a region between the point A and the point B, and the trailing edge of each of the blades, when viewed in the direction parallel to the axis of the shaft, being forward-curved in the rotational direction of the impeller with an angle between a line from the point O to point E and a line from the point O to the trailing edge increasing towards the outer periphery up to point D located between the point E and point B', the point E being a point of fixation to the hub, the point B' being an intersection with the outer peripheral edge, being backward-curved in the rotational direction of the impeller with an angle between a line from the point O to the point D and a line from the point O to the trailing edge increasing towards the outer periphery up to point A' located closer to the outer periphery than the point D is to the outer periphery in a region between the point D and the point B', and being forward-curved in the rotational direction of the impeller in a region between the point A' and the point B', each of the blades being reflexed at the point D and the point A' in the trailing edge, wherein a distance between the center of rotation and the point A on the leading edge and a distance between the center of rotation and the point A' on the trailing edge are in a certain relation to each other, the certain relation being defined as being within a predetermined range, and in a zone in which the point A and the point A' are connected along the rotational direction of the impeller, the closer to the point A' the more greatly the blade projects to a suction side, and in a zone along the rotational direction of the impeller including the point D on the trailing edge, the closer to the point D, the more greatly the blade projects to an outlet side such that a height difference in the direction of the shaft between a position of a maximum point and a position of a minimum point is greater on a side of the trailing edge than on a side of the leading edge.

2. An axial-flow fan, comprising:

an impeller that includes a hub and a plurality of blades, the hub being configured to rotate around an axis of a shaft and the plurality of blades being fixed to an outer peripheral portion of the hub and each defined by an inner peripheral edge, an outer peripheral edge, a leading edge, and a trailing edge, wherein a section of each of the blades including the shaft includes a maximum point, which is an apex on a suction side in a direction of the shaft, and a minimum point, which is an apex on an outlet side, and a height difference in the direction of the shaft between a position of the maximum point and a position of the minimum point is greater on a side of the trailing edge than on a side of the leading edge, wherein when viewed in a direction parallel to the axis of the shaft, a minimum point on the trailing edge is forward of a line segment E-B' in the rotational direction of the impeller, the line segment E-B' connecting point E and point B', the point E being a point of fixation of the trailing edge of the blade to the hub, the point B' being an intersection with the outer peripheral edge, and a maximum point on the trailing edge is rearward of the line segment E-B' in the rotational direction of the impeller.

3. The axial-flow fan of claim 2, wherein the leading edge of each of the blades, when viewed in the direction parallel to the axis of the shaft, has a forward-curving shape in the rotational direction of the impeller with an angle between a line from point O which is a center of the shaft to point C, and a line from the point O to the leading edge increasing towards the outer periphery of the impeller up to point A located between the point C and point B, the point C being a point of fixation to the hub, the point B being an intersection with the outer peripheral edge.

4. The axial-flow fan of claim 2, wherein the leading edge of each of the blades, when viewed in the direction parallel to the axis of the shaft, is shaped to extend along a radial direction from a center of rotation in a region between point A on the leading edge and point B, the point B being an intersection of the leading edge with the outer peripheral edge.

5. The axial-flow fan of claim 1, wherein the leading edge of each of the blades, when viewed in the direction parallel to the axis of the shaft, includes point A located between point C and point B, the point C being a point of fixation to the hub, the point B being an intersection with the outer peripheral edge, the trailing edge of each of the blades, when viewed in the direction parallel to the axis of the shaft, includes point D and point A', the point D being located between point E and point B', the point E being a point of fixation to the hub, the point B' being an intersection with the outer peripheral edge, and the point A' is located closer to the outer periphery than the point D is to the outer periphery, and the point A on the leading edge and the point A' on the trailing edge are positioned such that a distance $r_A$ between the center of rotation and the point A on the leading edge, a distance $r_{A'}$ between the center of rotation and the point A' on the trailing edge, a distance $r_{tip}$ between the center of rotation and the point B, and a distance $r_{hub}$ between the center of rotation and the point C satisfy $r_A > r_{hub} + (r_{tip} - r_{hub})/2$, $r_{A'} > r_{hub} + (r_{tip} - r_{hub})/2$, $0.84 < r_A / r_{tip} < 0.90$, and $0.84 < r_{A'} / r_{tip} < 0.90$.

6. The axial-flow fan of claim 1, wherein the leading edge of each of the blades, when viewed in the direction parallel to the axis of the shaft, includes point A located between point C and point B, the point C being a point of fixation to the hub, the point B being an intersection with the outer peripheral edge, the trailing edge of each of the blades, when viewed in the direction parallel to the axis of the shaft, includes point D and point A', where the point D is located between point E and point B', the point E being a point of fixation to the hub, the point B' being an intersection with the outer peripheral edge, and the point A' is located closer to the outer periphery than is the point D, and when viewed in the direction parallel to the axis of the shaft, the blade has a curved shape such that radii of curvature at the point A on the leading edge, the point D on the trailing edge, and the point A' on the trailing edge are $R_A$, $R_D$, and $R_{A'}$, respectively.

7. The axial-flow fan of claim 1, wherein the leading edge of each of the blades, when viewed in the direction parallel to the axis of the shaft, includes point A located between point C and point B, the point C being a point of fixation to the hub, the point B being an intersection with the outer peripheral edge, the trailing edge of each of the blades, when viewed in the direction of the shaft, includes point D and point A', where the point D is located between point E and point B', the point E being a point of fixation to the hub, the point B' being an intersection with the outer peripheral edge, and the point A' is located closer to the outer periphery than is the point D, and a distance between the center of rotation and the point A on the leading edge is 0.9 or more times to 1.1 or less times a distance between the center of rotation and the point A' on the trailing edge.

8. An outdoor unit comprising:

the axial-flow fan of claim 1;

a driving source configured to drive the axial-flow fan:

a heat exchanger; and a casing configured to house the axial-flow fan, the driving source, and the heat exchanger.

* * * * *